US006886359B2

(12) United States Patent
Yamazaki et al.

(10) Patent No.: US 6,886,359 B2
(45) Date of Patent: May 3, 2005

(54) SHOWCASE

(75) Inventors: Shouichi Yamazaki, Maebashi (JP); Nobuo Kanbayashi, Kodama-gun (JP); Hayato Zushida, Kiryu (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/752,514

(22) Filed: Jan. 8, 2004

(65) Prior Publication Data

US 2004/0177634 A1 Sep. 16, 2004

(30) Foreign Application Priority Data

Mar. 11, 2003 (JP) ..... 2003-065039

(51) Int. Cl.[7] ..... A47F 3/04
(52) U.S. Cl. ..... 62/248; 454/193
(58) Field of Search ..... 62/248, 255, 256, 62/314, 315, 440; 454/193

(56) References Cited

U.S. PATENT DOCUMENTS 4,648,247 A * 3/1987 Takizawa et al. ..... 62/256
4,760,708 A * 8/1988 Karashima ..... 62/256
4,949,554 A * 8/1990 Branz et al. ..... 62/248
4,964,281 A * 10/1990 Tanaka ..... 62/256
5,000,258 A * 3/1991 Negishi ..... 165/151
5,606,863 A * 3/1997 Kicklighter et al. ..... 62/89

FOREIGN PATENT DOCUMENTS

JP 08-114377 5/1996
JP 410253229 A * 9/1998
JP 02002257451 A * 9/2002
JP 02002267322 A * 9/2002
JP 2002295958 A * 10/2002
JP 2003061794 A * 3/2003

* cited by examiner

*Primary Examiner*—William E. Tapolcai
*Assistant Examiner*—Mohammad M. Ali
(74) *Attorney, Agent, or Firm*—Banner & Witcoff, Ltd.

(57) ABSTRACT

A showcase includes a showcase body having an upper face whose front end side is provided with a first waste heat air guide plate for guiding condensation prevention air upward that flows forward along an upper face of a top plate. The waste heat air is prevented from flowing into a goods-storing room through a front opening of the showcase body from the front end side of the top plate, thus positively preventing a reduction in cooling efficiency in the goods-storing room, whereby effective cooling in the goods-storing room can be achieved, without the need of providing an air curtain at the front face of the showcase body.

7 Claims, 7 Drawing Sheets

SHOWCASE

CROSS-REFERENCE TO THE RELATED ART

This application incorporates by reference the subject matter of Application No. 2003-065039, filed in Japan on Mar. 11, 2003, on which a priority claim is based under 35 U.S.C § 119(a).

BACKGROUND OF THE INVENTION

1. Technical Field

The present invention relates to a showcase installed in a shop such as a convenience store for cooling and storing goods including foods, beverages, etc.

2. Related Art

A showcase is known which comprises a showcase body having a front opening, a goods-storing room formed in the showcase body, and a cooling system for cooling the goods-storing room, wherein an upper face of the showcase body is formed by a transparent material so that the interior of the showcase body can be seen from the outside (see, JP-A-8-114377 for instance).

This showcase body is designed that waste heat air from equipment disposed below the showcase body ascends along a rear face of the showcase body and is then discharged forward from a rear end of an upper face of the showcase body along the upper face of the showcase body, whereby dew condensation thereon is prevented.

However, with the aforementioned showcase in which waste heat air for condensation prevention is discharged to the front of the showcase body along the upper face thereof, the waste heat air can flow into the goods-storing room through the front opening of the showcase body, thus causing a problem that the cooling efficiency in the goods-storing room is lowered.

SUMMARY OF THE INVENTION

An object of the present invention is to provide a showcase in which the cooling efficiency in a goods-storing room is not lowered due to penetration of air for condensation prevention, even if such air is discharged to an upper face of a showcase body.

A showcase according to the present invention comprises a showcase body having a front opening, a goods-storing room provided in the showcase body, and cooling means for cooling the goods-storing room, wherein an upper face of the showcase body is designed to be transparent so that the goods-storing room can be seen from outward, air for condensation prevention is discharged forward from a rear end side of the showcase body along the upper face of the showcase body, and an air guide member for guiding the air for condensation prevention upward is provided at a front end side of the upper face of the showcase body.

In the showcase of this invention, air flowing along the upper face of the showcase body to reach the front end side of the showcase body does not flow into the goods-storing room from the front end side of the upper face of the showcase body through the front opening of the showcase body. This makes it possible to positively prevent a reduction in cooling efficiency in the goods-storing room.

In the present invention, the air guide member may be formed by a transparent member. In this case, since the air guide member is transparent, the goods-storing room can be seen even through the air guide member, and hence the visibility from above the upper face of the showcase body is not impaired.

The showcase may comprise a rear face side air passage in which the air for condensation prevention flows from below to upward along a rear face of the showcase body, and an upper face side air passage provided on a rear end side of the upper face of the showcase body, from which air in the rear face side air passage is discharged forward. The rear face side air passage may be provided to deviate toward one widthwise end of the showcase body, and the upper face side air passage may be provided with air guide members for guiding the discharged air so as to be dispersed throughout from the one widthwise end of the show case body to another widthwise end thereof. Preferably, these air guide members are spaced from one another in a width direction of the showcase body and disposed at predetermined inclination angles, respectively, with respect to a direction in which the discharged air is discharged. The inclination angle of the air guide member disposed closer to one widthwise end of the showcase body is larger than that of the air guide member disposed closer to another widthwise end of the showcase body.

In this case, since the rear face side air passage is provided to deviate to one widthwise end side of the showcase body, other equipment can be disposed on another widthwise end side thereof, so that an installation space for the other equipment does not project toward the backward of the showcase body and hence the showcase body is not made large in size. Further, by means of the air guide members provided in the upper face side air passage, the condensation prevention air discharged from the upper face side air passage is dispersed throughout from the one widthwise end side to another widthwise end side of the showcase body. Thus, even when the rear face side air passage is disposed to deviate to the one widthwise end side of the showcase body, the condensation prevention air is evenly discharged from the upper face side air passage over the entire of the upper face of the showcase body, making it possible to positively prevent occurrences of condensation on the upper face of the showcase body.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION

Figure 1:
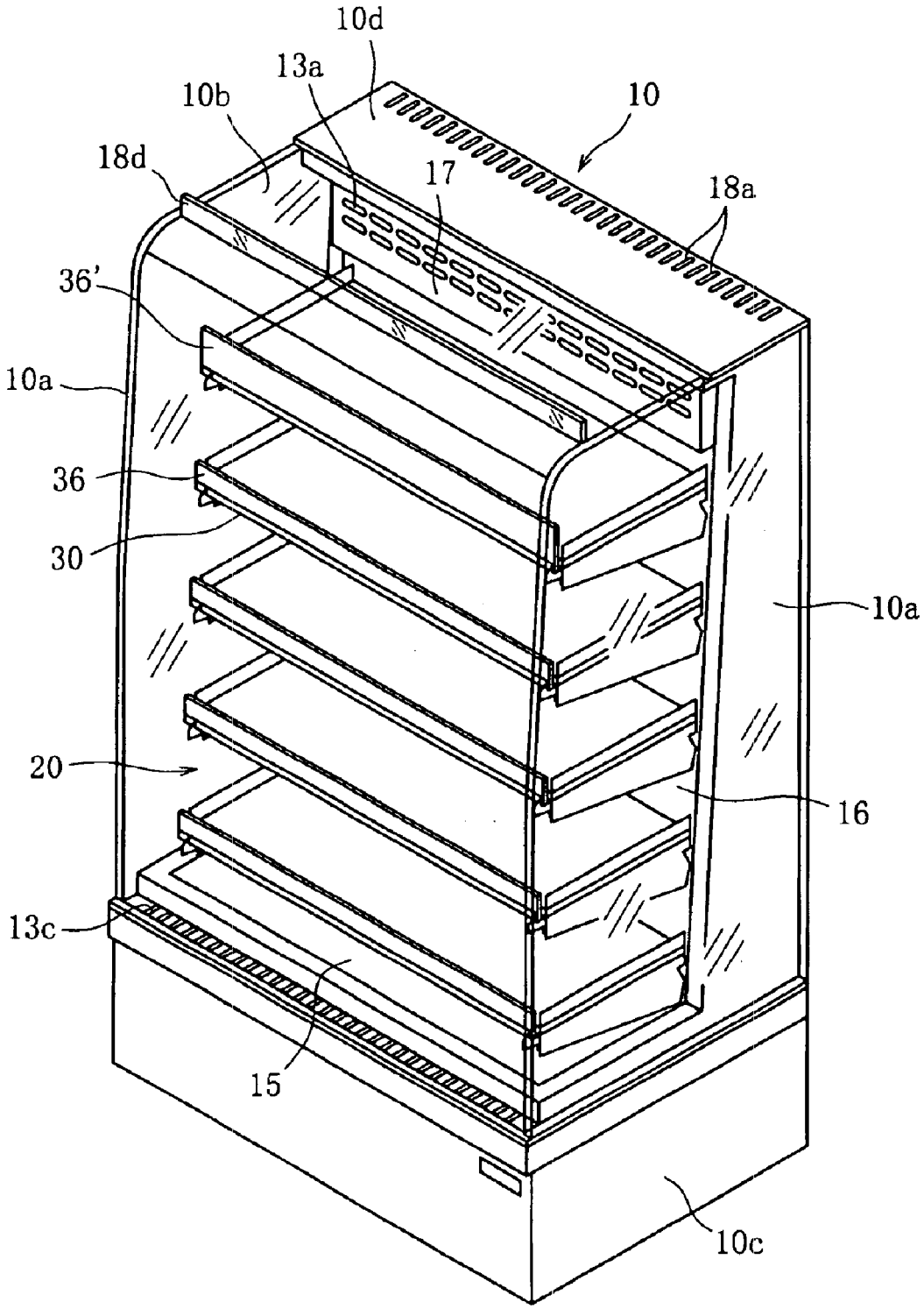
FIG. 1 is an overall perspective view of a showcase according to an embodiment of this invention.
Figure 2:
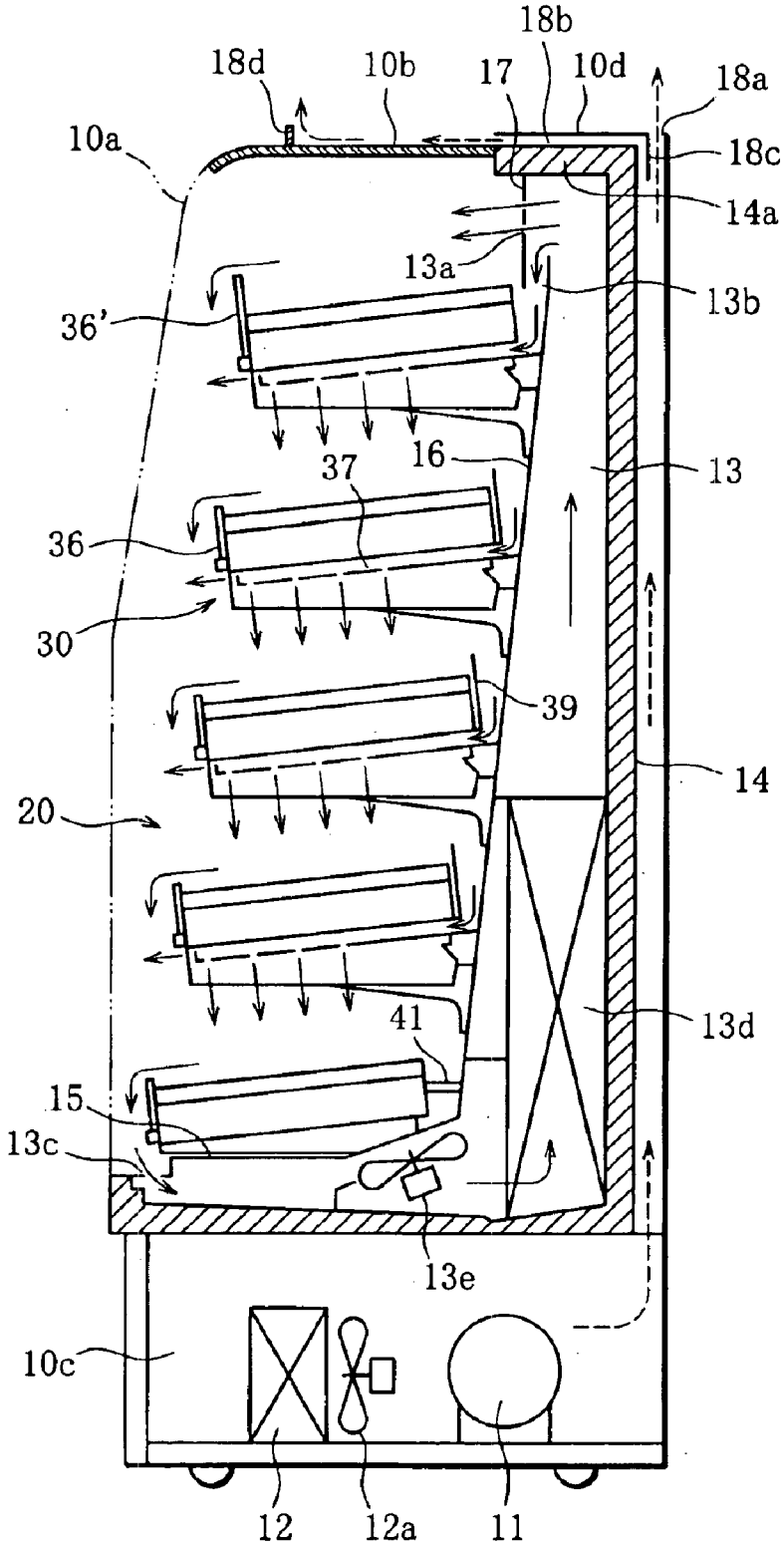
FIG. 2 is a sectional side view of the showcase.
Figure 3:
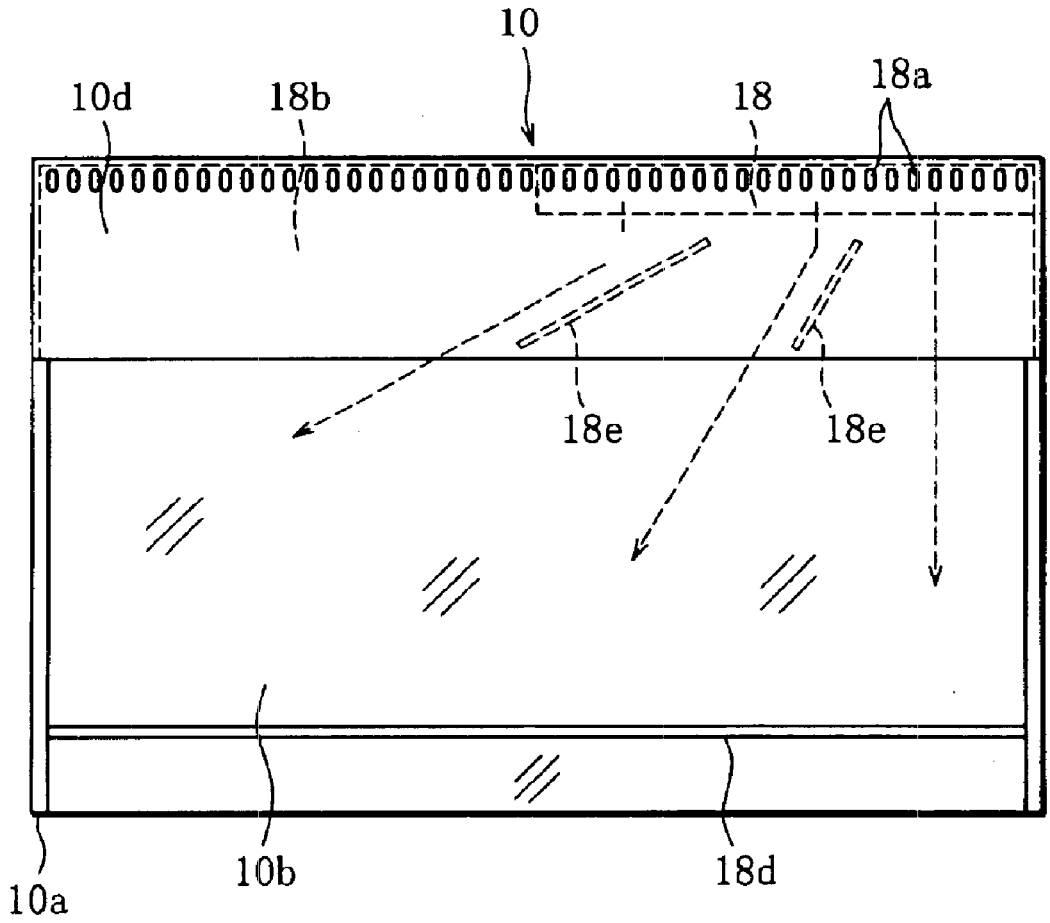
FIG. 3 is a plan view of the showcase.
Figure 4:
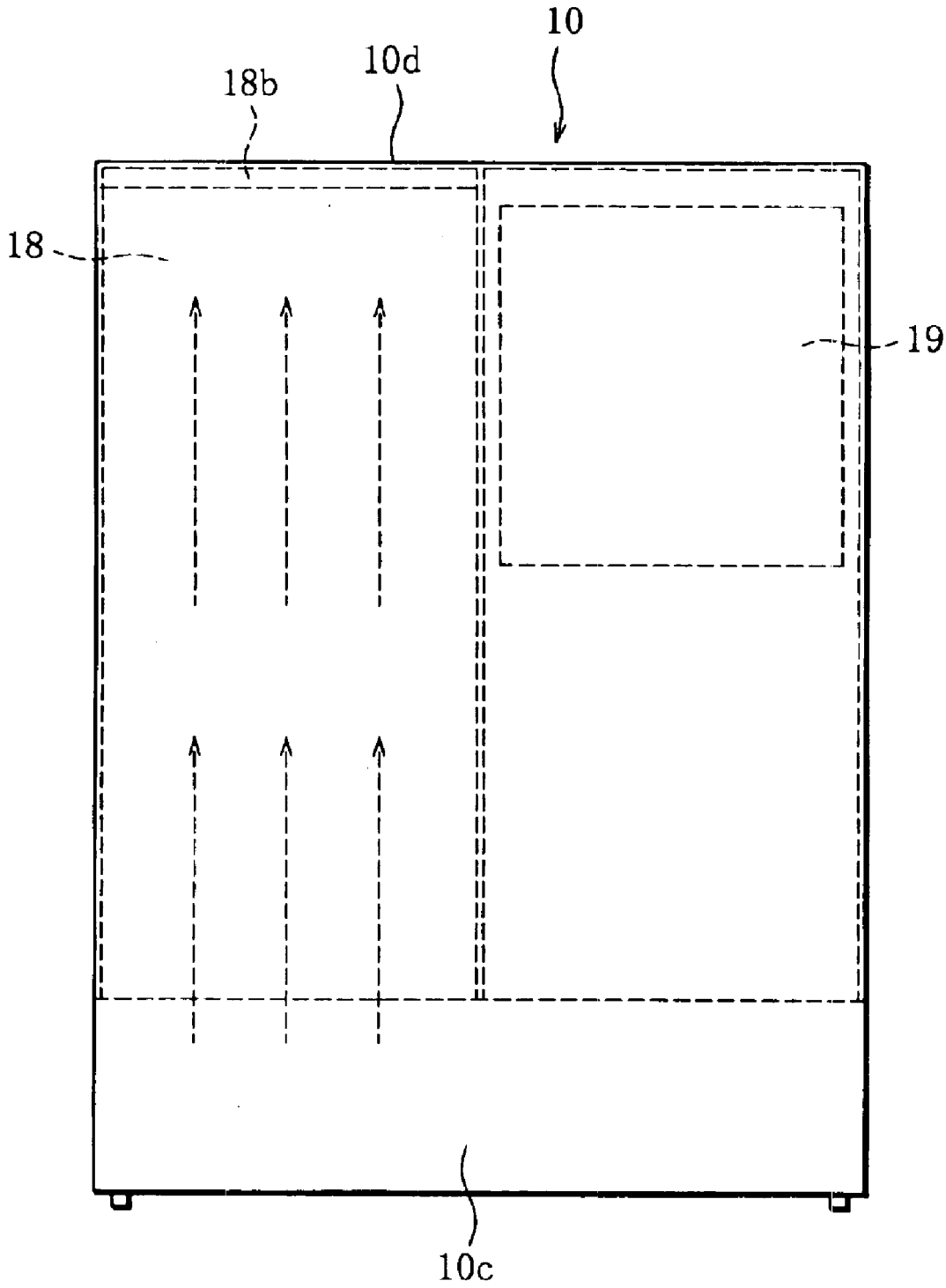
FIG. 4 is a rear view of the showcase.
Figure 5:
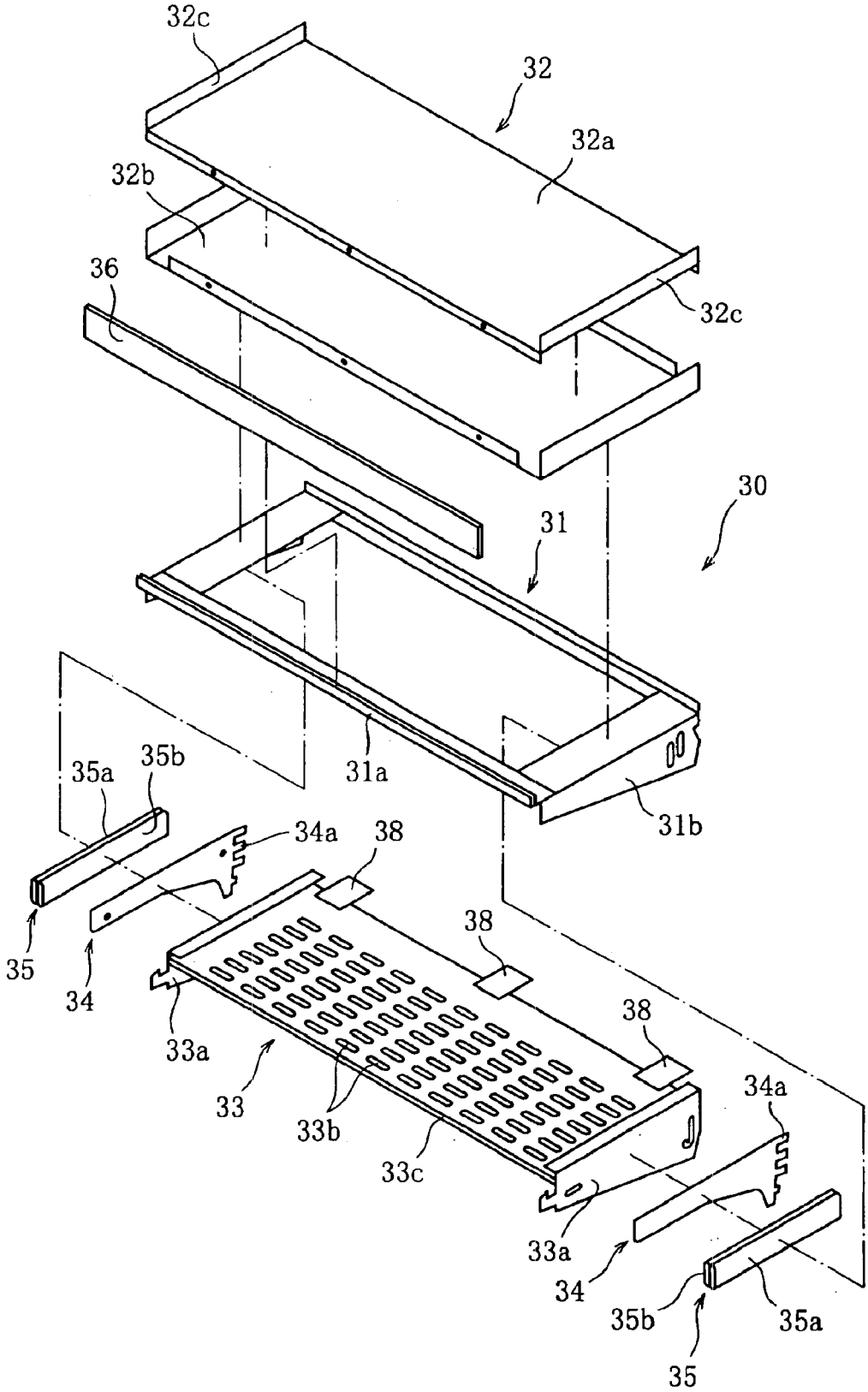
FIG. 5 is an exploded perspective view of a goods shelf.
Figure 6:
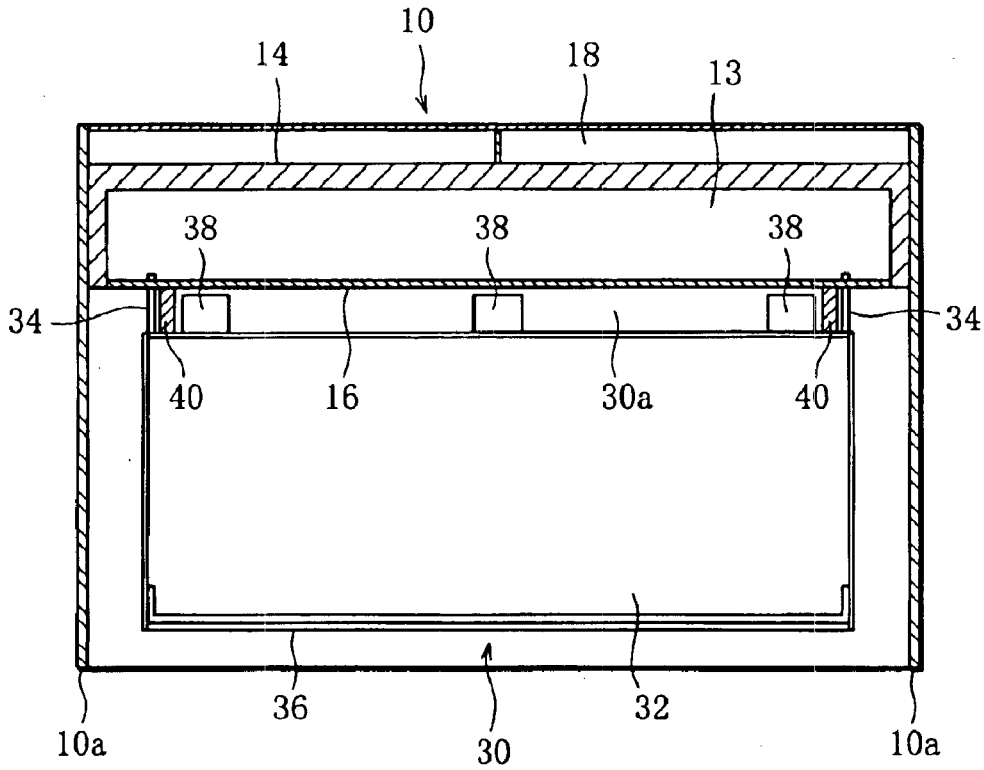
FIG. 6 is a sectional plan view of the showcase.
Figure 7:
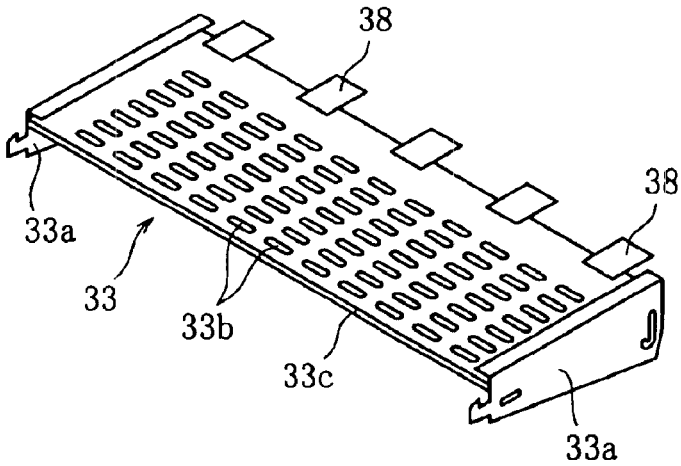
FIG. 7 is a perspective view of a fourth-stage lower shelf board.
Figure 8:
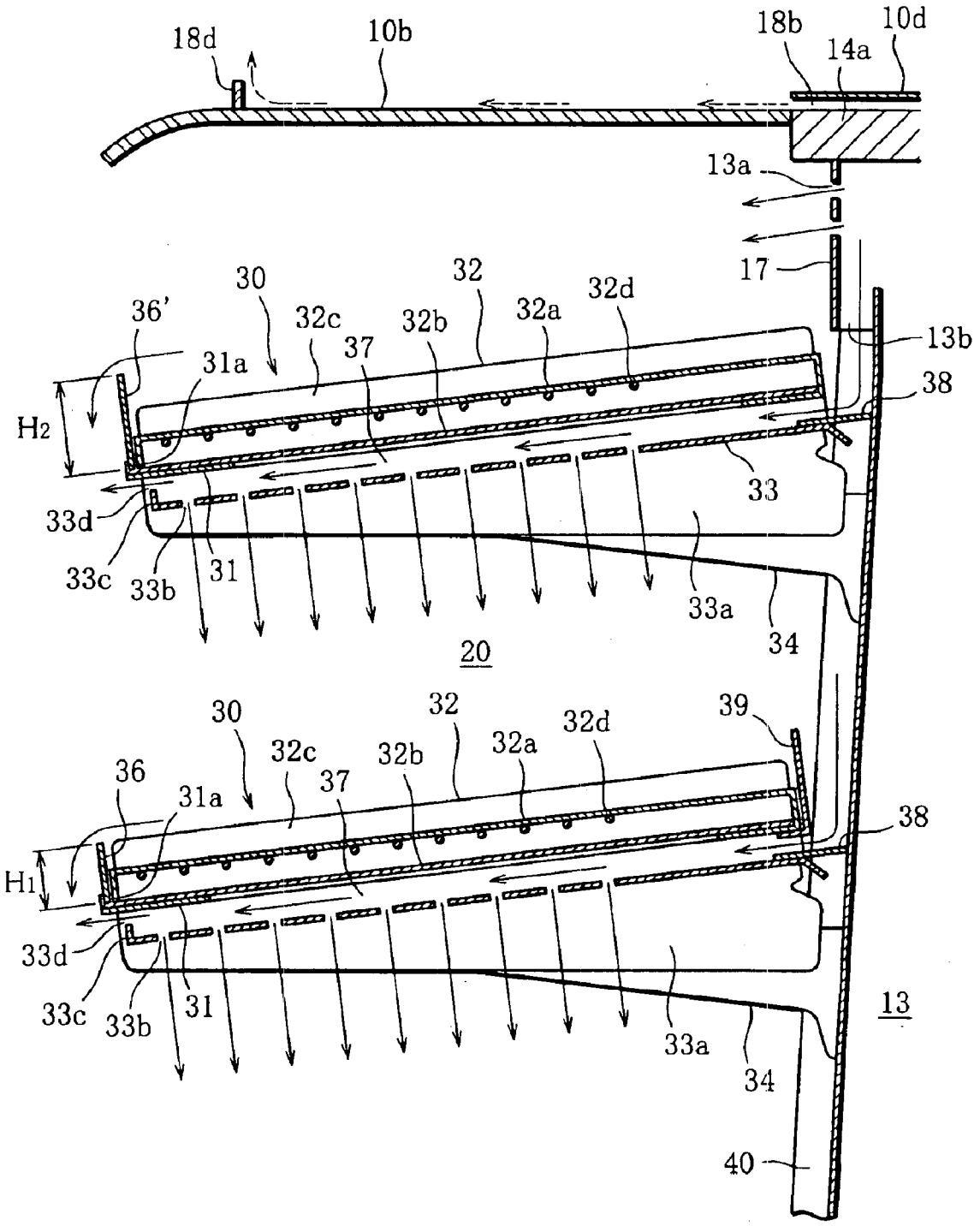
FIG. 8 is a sectional side view showing an essential part of the showcase.

Referring to FIGS. 1–8, a showcase according to an embodiment of this invention is shown, which comprises a showcase body 10 having a front opening, a goods-storing room 20 provided in the showcase body 10, and a plurality of goods shelves 30 that are arranged in five stages in the goods-storing room 20 so as to be vertically spaced from one another.

The showcase body 10 includes a pair of side plates 10*a* and a top plate 10*b* by which side faces and top face of the showcase body are covered respectively. The side plates 10*a* and top plate 10*b* are each constituted by a transparent member such as a glass plate, acrylic plate, or the like, so that the interior of the showcase body 10 can be seen from outward. A machinery room 10*c* is provided beneath the showcase body 10. Pieces of refrigeration equipment such as a compressor 11, condenser 12, condenser fan 12*a*, etc., are accommodated in the machinery room 10*c*.

In the showcase body 10, a ventilation passage 13 is provided, which extends along bottom and rear faces of the goods-storing room 20. The ventilation passage 13 is surrounded by a thermally insulating wall 14 and partitioned from the goods-storing room 20 by means of bottom and rear plates 15, 16 interposed therebetween. An upper end of the ventilation passage 13 is covered by an upper face portion 14*a* of the thermally insulating wall 14. An air guide plate 17 provided at a lower face of the upper face portion 14*a* is formed with a large number of ventilation holes serving as first air outlets 13*a*. The air guide plate 17 extends vertically downward from the upper face portion 14*a* of the thermally insulating wall 14. A lower end side of the air guide plate faces an upper end side of the rear plate 16, so that they overlap each other with a spacing therebetween. Thus, a second air outlet 13*b* is defined between the air guide plate 17 and the rear plate 16. Specifically, part of air in the ventilation passage 13 is discharged forward from the first air outlets 13*a*, and the remaining air is discharged downward from the second air outlet 13*b* to flow downward along the rear plate 16. An air inlet 13*c* for the ventilation passage 13 is provided at a lower end of the front opening of the showcase body 10, so that air in the goods-storing room 20 is sucked into the ventilation passage 13 via the air inlet 13*c*. In the ventilation passage 13, a cooler 13*d* and a blower 13*e* are provided. The cooler 13*d* is disposed on the rear face side of the ventilation passage 13, whereas the blower 13*e* is disposed on the bottom face side thereof.

In a rear face side of the showcase body 10 is provided an exhaust passage 18 through which the waste heat air in the machinery room 10*c* flows upward. The exhaust passage 18 vertically extends along the rear face of the showcase body 10, and is communicated at its lower end side with the machinery room 10*c*. The exhaust passage 18 has its upper end which is in communication with a number of air exits 18*a* formed in an upper plate 10*d* of the showcase body 10, and which is also in communication with a discharge duct 18*b* formed between the upper plate 10*d* and the upper face portion 14*a* of the thermally insulating wall 14. A depth dimension of the upper plate 10*d* is substantially equal to that of the upper face portion 14*a* of the thermally insulating wall 14, so that a front end of the discharge duct 18*b* is located on a rear end side of the top plate 10*b*. An upper end side of the exhaust passage 18 is partitioned in the depthwise direction by a partition plate 18*c* extending downward from the upper plate 10*d*. Thus, part of air in the exhaust passage 18 is split to the discharge duct 18 and discharged forward, as condensation prevention air, along the top plate 10*b*. Specifically, the exhaust passage 18 constitutes a rear face side air passage, and the discharge duct 18*b* constitutes an upper face side air passage. At a front end side of the upper face of the showcase body 10, a first waste heat air guide plate 18*d* serving as an air guide plate for guiding air upward that is discharged from the discharge duct 18*b*. The first waste heat air guide plate 18*d* is constituted by a transparent member such as a glass plate, acrylic plate, or the like, and formed to have a width substantially equal to that of the top plate 10*b*.

The exhaust passage 18 is formed to have a width that is about half as large as that of the rear face of the showcase body 10, and arranged to deviate toward one end side of the showcase body 10 in the width direction. At another widthwise end side of the showcase body 10, an electrical equipment box 19 is disposed. Further, a plurality of second waste heat air guide plates 18*e* are provided that serve as air guide members for dispersing waste heat air discharged from the exhaust passage 18 throughout from one widthwise end side to another widthwise end side of the showcase body 10. In the discharge duct 18*b*, these second waste heat air guide plates 18*e* are spaced from one another in the width direction, and are each disposed at a predetermined inclination angle with respect to the direction in which air is discharged. The inclination angle of the second waste heat air guide plate 18*e* disposed closer to the one widthwise end side of the showcase body 10 is larger than that of the guide plate 18*e* disposed closer to the other widthwise end side of the showcase body.

The goods-storing room 20 is surrounded by the side plates 10*a*, top plate 10*b*, bottom plate 15 and rear plate 16, and is arranged that goods are loaded onto and unloaded from goods shelves 30 from the front side of the goods-storing room.

Each of the goods shelves 30 is constituted by a shelf body 31 formed into a frame shape, an upper shelf plate 32 disposed on the shelf body 31, a lower shelf plate 33 disposed below the shelf body 31, a pair of left and right brackets 34 supporting the shelf body 31, a pair of left and right slide rails 35 for a depthwise slide motion of the shelf body 31, and a goods guard 36 disposed at a front end of the shelf body 31. A gap 30*a* for air flow is defined between a rear end of the goods shelf and the rear plate 16 of the showcase body 10.

The shelf body 31 has its front end provided with a grooved retainer 31*a* for detachably holding the goods guard 36, and widthwise ends thereof provided with side portions 31*b* extending downward.

The upper shelf plate 32 is constituted by upper and lower members 32*a*, 32*b* each of which is formed into a flat plate. The upper member 32*a* has its widthwise ends provided with side wall portions 32 extending upward. The upper shelf plate 32 is formed into a box by assembling the upper and lower members 32*a*, 32*b* with a spacing therebetween, and fixed to the upper face of the shelf body 31. Further, the upper shelf plate 32 is mounted at its bottom face with a heater 32*d* that is used to heat goods placed on the goods shelf 30.

The lower shelf plate 33 is formed into a flat plate and disposed below the shelf body 31 with a spacing from the bottom face of the upper shelf plate 32. A shelf duct 37 is formed between the upper and lower shelf plates 32 and 33, and has an open rear end for air intake. Widthwise side faces of the shelf duct 37 are covered respectively by a pair of side plates 33*a* attached to the lower shelf plate 33. Air in the shelf duct 37 is discharged downward through a number of air outlets 33*b* formed in the lower shelf plate 33, and also discharged forward from the front end side of the lower shelf plate 33. At the front end of the lower shelf plate 33 is provided a front wall 33*c* having a height smaller than the spacing between the shelf plates 32, 33, so that air can be discharged from an opening 33*d* between the upper end of the front wall 33*c* and the shelf body 31.

The brackets 4 are formed to extend the depthwise direction, and coupled to the side plates 33*a* of the lower shelf plate 33. Each bracket 34 has its rear end formed with an engagement piece 34*a* that is adapted to be engaged with the rear plate 16 of the showcase body 10. Specifically, the engagement piece 34*a* is engageable with an arbitrary one of a number of holes (not shown) provided in the rear plate 16 to be vertically spaced from one another.

Each of the slide rails 35 is a conventional one which is constituted by a pair of slide members 35*a*, 35*b* assembled to be slidable to each other, and interposed between the inner side of the side portion 31*b* of the shelf body 31 and the bracket 34, thus coupling the shelf body 31 to the bracket 34 for movement in the depthwise direction.

Each goods guard 36 is constituted by a plate member such as an acrylic plate, and detachably mounted to the retainer 31*a* of the shelf body 31. As compared to a height dimension H1 of goods guards 36 mounted to goods shelves 30 disposed at the second to fifth stages counted from top, a height dimension H2 of the goods guard 36' mounted to the goods shelf 30 disposed at the uppermost stage is larger by a predetermined height. Thus, the goods guard 36' for the uppermost stage serves as a discharge restriction member that makes it possible to suppress air on the uppermost stage goods shelf 30 from being discharged forwardly.

At the rear end of the lower shelf plate 33, a plurality of first air guide plates 38 for introducing air into the shelf duct 37 are mounted so as to be spaced from one another in the width direction. The first air guide plates 38 are attached so as to project into a gap 30*a* between the lower shelf plate 33 and the rear plate 16, so that part of air that descends along the rear plate 16 is guided by each of the first air guide plates 38 toward the corresponding shelf duct 37. For each of the first to third stage goods shelves 30, three first air guide plates 38 are mounted (see FIG. 5), whereas five first air guide plates 38 are mounted to the fourth stage goods shelf 40 (see FIG. 7).

Furthermore, the second to fourth stage goods shelves 30 are provided with second air guide plates 39 for guiding air that descends along the rear plate 16 toward the gaps 30*a* between the shelves 30 and the rear plate 16. Each of the second air guide plates 39 is mounted to the rear end side of the shelf body 31 concerned so as to extend upward, and is slightly inclined forward so as to easily guide the descending air.

On the backward of each goods shelf 30, a pair of third air guide plates 40 are provided that cover the gap 30*a* between the goods shelf 30 and the rear plate 16 from both widthwise sides. The third air guide plate 40 are each constituted by a soft member such as rubber that is expandable in the vertical direction, and mounted to the rear plate 16 of the showcase body 10.

The lowermost stage goods shelf 30 is provided with no shelf duct 37, and the gap 30*a* between its rear end and the rear plate 16 is closed by an air flow restriction plate 41.

In the showcase constructed as explained above, air sucked from the air inlet 13*c* into the ventilation passage 13 is cooled by means of the cooler 13*d*, and the cooled air is discharged from the first and second air outlets 13*a*, 13*b* of the ventilation passage 13, whereby the inside of the goods-storing room 20 is cooled. The air discharged from the first air outlet 13*a* flows forward along the upper face of the uppermost stage goods shelf 30, whereas the air discharged from the second air outlet 13*b* passes through the gap 30*a* between the goods shelves 30 and the rear plate 16, and descends along the rear plate 16 of the showcase body 10. As for the air descending along the rear plate 16, the second air guide plates 39 restrict the air from flowing toward the upper faces of the second to fourth stage goods shelves 30, and the third air guide plates 40 restrict the air from flowing toward the sides of the goods shelves 30.

The air descending along the rear plate 16 flows into the rear end side of the shelf ducts 37 with the aid of the first guide plates 38 of the first to fourth stage goods shelves 30. At this time, the air descending along the rear plate 16 enters into the shelf ducts 37 of the goods shelves 30 in sequence from upper one to lower one. Since the first air guide plates 38 for upper goods shelves 30 (the first to third stage goods shelves) are smaller in number as compared to those of a lower goods shelf 30 (the fourth stage goods shelf), amounts of air flowing into the shelf ducts 37 of the goods shelves 30 are substantially made even for these upper and lower ducts.

Then, the air flowing into each of the shelf ducts 37 flows therethrough toward the front end of the goods shelf 30, while being discharged to the upper face of the next lower goods shelf 30 through the air outlets 33*b* of the lower shelf plate 33. As a result, goods placed on the goods shelf 30 are cooled by the air discharged from the shelf duct 37 of the upper goods shelf 30. The goods guard 36' mounted to the uppermost stage goods shelf 30 has a height dimension that is larger than that of the goods guards 36 for the other goods shelves 30, so that air may easily accumulate on the upper face of the uppermost stage goods shelf 30 as compared to the other goods shelves 30. Thus, the air discharged from the first air outlets 13*a* is prevented from being excessively discharged from front of the uppermost stage goods shelf 30. Meanwhile, air in the shelf duct 37 is also discharged from the opening 33*d* at the front end side of the shelf duct 37, and the discharged air serves to prevent drew condensation on the front end side of the goods shelf 30.

The waste heat air generated by the compressor 11, the condenser 12, etc. in the machinery room 10*c* is caused to flow into the exhaust passage 18 by means of a blower, not shown, and part of which is discharged from the discharge duct 18*b* to the upper face of the top plate 10*b*, with the remaining air discharged from the air exits 18*a* to above the showcase body 10. Since the top plate 10*b* is in contact at its lower face with cold air in the goods-storing room 20, dew condensation tends to be produced on the upper face of the top plate, but such condensation on the top plate 10*b* is prevented by waste heat air, which is at a higher temperature and discharged from the discharge duct 18*b* to the upper face of the top plate 10*b*. At this time, the air in the discharge duct 18*b* is guided so as to be dispersed by the second waste heat air guide plates 18*e* throughout from the one widthwise end to the other widthwise end of the showcase body 10, whereby the waste heat air is evenly discharged from the discharge duct 18*b* over the entirety of the top plate 10*b*. The air having flowed up to the front end of the top plate 10*b* along the upper face of the top plate is guided upward by the first waste heat guide plate 18*d*, and thus the waste heat air never flows into the goods-storing room 20 from the front end side of the top plate 10*b* through the front opening of the showcase body 10.

As described above, according to the showcase of this embodiment, in which the waste heat air for condensation prevention flowing forward along the top plate 10*b* is guided upward by means of the first waste heat air guide plate 18*d* provided at the front end of the upper face of the showcase body, the waste heat air is prevented from flowing into the goods-storing room 20 through the front opening of the showcase body 10 from the front end side of the showcase body, making it possible to reliably prevent a reduction in cooling efficiency in the goods-storing room 20.

In the embodiment, the first waste heat air guide plate 18*d* is formed by a transparent member, and hence the interior of the goods-storing room 20 can be seen even through the first waste heat air guide plate 18*d*. This is advantageous in that the visibility is not impaired by the presence of the top plate 10*b*.

Furthermore, the exhaust passage 18 is provided to widthwise deviate toward one end side of the showcase body 10 and the electrical equipment box 19 is disposed on the other widthwise end side of the showcase body 10. Thus, the installation space for the electrical equipment box 19 never projects rearward beyond the rear of the showcase body 10. This is advantageous in that the showcase body 10 is not made large in size. In the embodiment, the waste heat air discharged to the upper face of the top plate 10*b* is dispersed throughout from one widthwise end side of the showcase body 10 to the other widthwise end side thereof by means of a plurality of second waste heat air guide plates 18*e* that are provided in the discharge duct 18*b* of the exhaust passage 18. This makes it possible to evenly discharge the waste heat air from the discharge duct 18*b* over the entire of the top plate 10*b*, thus reliably preventing occurrences of dew condensation on the top plate 10*b*.

Although the showcase in which the electrical equipment box 19 is disposed laterally to the exhaust passage 18 has been described in the embodiment, other equipment may be disposed therein.

In the embodiment, the waste heat air in the machinery room 10*c* is utilized as condensation prevention air, however, air heated by using a heater or the like may be discharged, as condensation prevention air, to the upper face of the showcase body 10.

What is claimed is:

1. A showcase comprising:

a showcase body having a front opening;

a goods-storing room provided in the showcase body; and cooling means for cooling the goods-storing room, wherein an upper face of said showcase body is designed to be transparent so that said goods-storing room can be seen from outward, air for condensation prevention is discharged forward from a rear end side of said showcase body along the upper face of said showcase body, and an air guide member for guiding the air for condensation prevention upward is provided at a front end side of the upper face of said showcase body.

2. The showcase according to claim 1, wherein the air guide member is formed by a transparent member.

3. The showcase according to claim 1, further comprising:

a rear face side air passage in which the air for condensation prevention flows from below to upward along a rear face of the showcase body; and an upper face side air passage provided on a rear end side of the upper face of the showcase body, from which air in the rear face side air passage is discharge forward, wherein the rear face side air passage is provided to deviate toward one widthwise end of the showcase body, and the upper face side air passage is provided with air guide members for guiding the discharged air so as to be dispersed throughout from the one widthwise end of the showcase body to another widthwise end thereof.

4. The showcase according to claim 3, wherein the air guide members provided in the upper face side air passage are spaced from one another in a width direction of the showcase body and disposed at predetermined inclination angles, respectively, with respect to a direction in which the discharged air is discharged.

5. The showcase according to claim 4, wherein the inclination angle of the air guide member disposed closer to one widthwise end of the showcase body is larger than that of the air guide member disposed closer to another widthwise end of the showcase body.

6. The showcase according to claim 2, further comprising:

a rear face side air passage in which the air for condensation prevention flows from below to upward along a rear face of the showcase body; and an upper face side air passage provided on a rear end side of the upper face of the showcase body, from which air in the rear face aide air passage is discharge forward, wherein the rear face side air passage is provided to deviate toward on widthwise end of the showcase body, and the upper face side air passage is provided with air guide members for guiding the discharged air so as to be dispersed throughout from the one widthwise end of the showcase body to another widthwise end thereof.

7. A showcase comprising:

a showcase body having a front opening;

a goods-storing room provided in the showcase body; and cooling means for cooling the goods-storing room, wherein an upper face of said showcase body is designed to be transparent so that said goods-storing room can be seen from outward, the upper face having an upper surface and a lower surface, air for condensation prevention is discharged in a forward direction and along the upper surface of the upper face from an air outlet located at a rear end side of the upper face, and an air guide member for guiding the air in an upward direction is provided at a front end side of the upper face, the sir guide member being separate from the air outlet.

* * * * *

UNITED STATES PATENT AND TRADEMARK OFFICE

CERTIFICATE OF CORRECTION

PATENT NO. : 6,886,359 B2
DATED : May 3, 2005
INVENTOR(S) : Shouichi Yamazaki et al.

It is certified that error appears in the above-identified patent and that said Letters Patent is hereby corrected as shown below:

Column 8,
Line 27, change “aide” to -- side --;
Line 52, change “sir” to -- air --.

Signed and Sealed this

Thirteenth Day of September, 2005

JON W. DUDAS
*Director of the United States Patent and Trademark Office*